United States Patent [19]

Eiermann

[11] Patent Number: 5,049,049

[45] Date of Patent: Sep. 17, 1991

[54] ROTARY PISTON INTERNAL COMBUSTION ENGINE

[75] Inventor: Dankwart Eiermann, Weissensberg, Fed. Rep. of Germany

[73] Assignee: Wankel GmbH, Berlin, Fed. Rep. of Germany

[21] Appl. No.: 525,472

[22] Filed: May 18, 1990

[51] Int. Cl.[5] ..... F01C 1/22; F01C 19/12

[52] U.S. Cl. ..... 418/61.2; 418/144

[58] Field of Search ..... 418/61.2, 91, 94, 142, 418/144

[56] References Cited

U.S. PATENT DOCUMENTS

| | | | |
|---|---|---|---|
| 3,249,094 | 5/1966 | Höppner et al. | 418/61.2 |
| 3,323,712 | 6/1967 | Froede et al. | 418/61.2 |
| 3,333,763 | 8/1967 | Jungbluth et al. | 418/61.2 |
| 3,743,449 | 7/1973 | Steinwart | 418/61.2 |
| 4,297,090 | 10/1981 | Hoffmann | 418/61.2 |

*Primary Examiner*—Leonard E. Smith
*Assistant Examiner*—David L. Cavanaugh
*Attorney, Agent, or Firm*—Robert W. Becker & Associates

[57] ABSTRACT

A rotary piston internal combustion engine of trochoidal-type of construction with a slidably journalled piston controlled by a synchronous transmission gear drive unit, with which the synchronous transmission gear drive unit is covered coinciding with an insert part threaded with respect to the remaining machine parts adjacent to the eccentric. The insert part has a hollow cylinder covering the hollow gear of the synchronous transmission gear drive unit eccentric to the eccentric shaft, which hollow cylinder is sealed-off with a sealing ring relative to one shoulder of the piston, as well as a further hollow cylinder coaxial to the eccentric shaft surrounding the holding part for the pinion with a gap or space therebetween, which further hollow cylinder projects into a shaft bore in the side part and is sealed-off relative thereto by a sealing ring. Upon another bearing side there is provided an annular chamber sealed-off relative to the remaining machining spaces or chambers and from which annular chamber the oil discharging from the bearing is conveyed through the cooling chambers of the piston to the synchronous transmission gear drive unit. The oil is discharged through a gap space in a discharge passage or channel in the sidewall formed by the coaxial hollow cylinder.

3 Claims, 3 Drawing Sheets

ROTARY PISTON INTERNAL COMBUSTION ENGINE

BACKGROUND OF THE INVENTION

1. Field of the Invention

The present invention relates to a rotary piston internal combustion engine having an oil-cooled piston journalled by a friction bearing, plane, sliding or sleeve bearing in a housing which consists of two side parts and a casing mantle part with dual-arc trochoidal-shaped casing mantle runway inner surfacing. An eccentric shaft journalled in the side parts passes axially through the housing. An eccentric on the eccentric shaft has a triangular pist n rotating as controlled by a synchronous transmission gear drive unit which is provided in the piston between the eccentric and one of the side parts. The synchronous transmission gear drive unit is formed by a hollow gear stationary or fixed on the piston and a pinion fixed or stationary on the housing located around the eccentric shaft.

2. Description of the Prior Art

Conventionally the lubricating- and coolingoil with such machines is supplied via axial and radial bores in the shaft into the slide bearing of the eccentric and from there into the cooling hollow chambers of the piston as well as directly into the transmission gear drive unit and to the outer side of the piston. Both the bearing lubrication as well as the cooling of the piston require a very considerable through-passage or volume of oil under pressure, which penetrates between the piston- and housing-sidewalls and there must be kept away from the working chambers and combustion procedures by oil inner seals, so-called scraper rings, in order not to cause intolerable exhaust or waste gas values. The oil inner seals however are costly and complex and additionally are not reliable. Furthermore, these oil inner seals require structural space between the hollow gear of the transmission drive unit and the axial gas seals and with that also restricting or narrowing other constructive possibilities.

SUMMARY OF THE INVENTION

An object of the present invention is to provide an arrangement for the circulation of oil that is under pressure for lubrication of the slide bearing and for cooling of the piston to be kept away from the intermediate space between the housing sidewalls and the piston and kept away from the gas seals of the piston.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
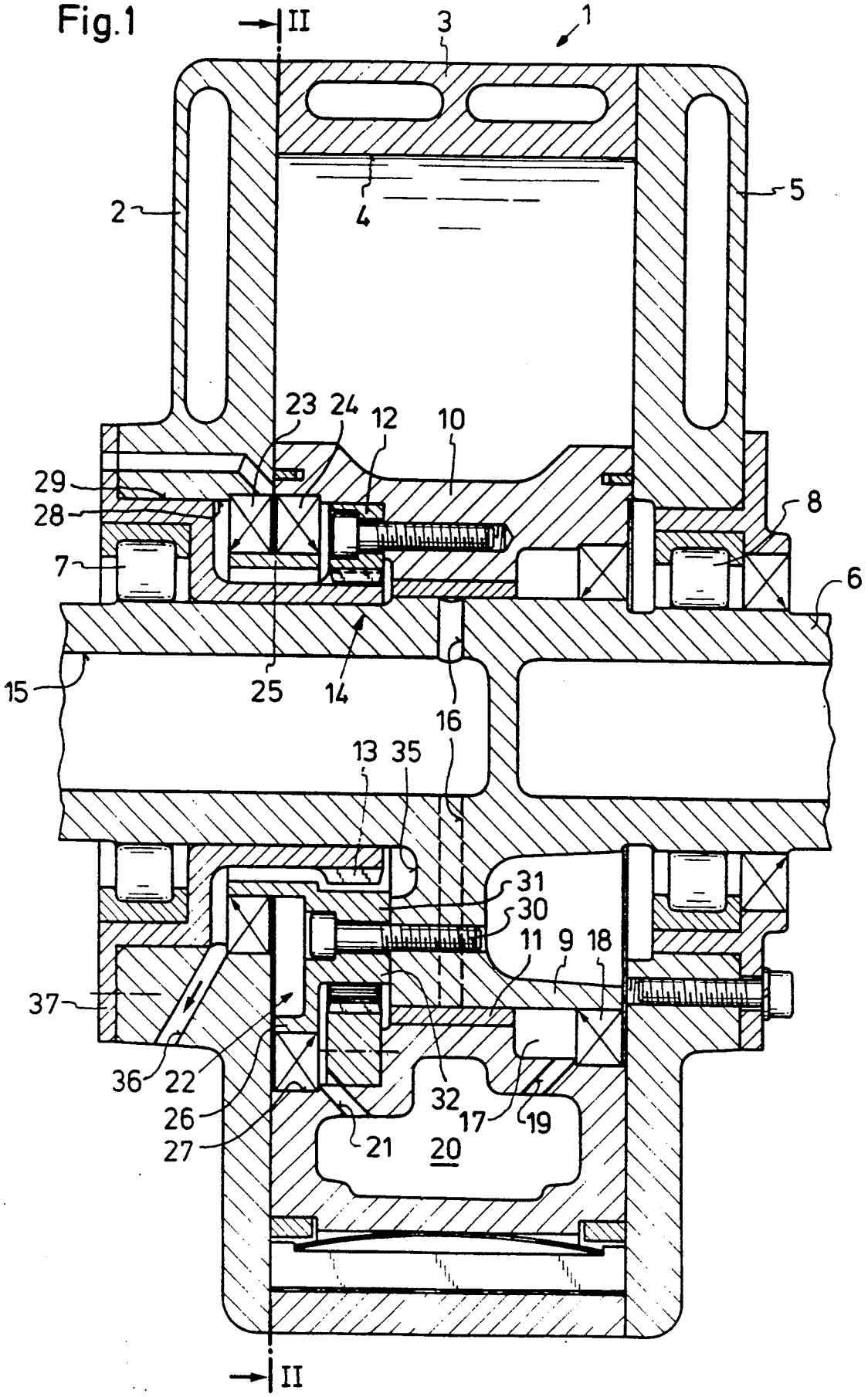
FIG. 1 is a view that shows an axial section taken along line I—I in FIG. 2 in a plane through an internal combustion engine having features in accordance with the present invention.
Figure 2:
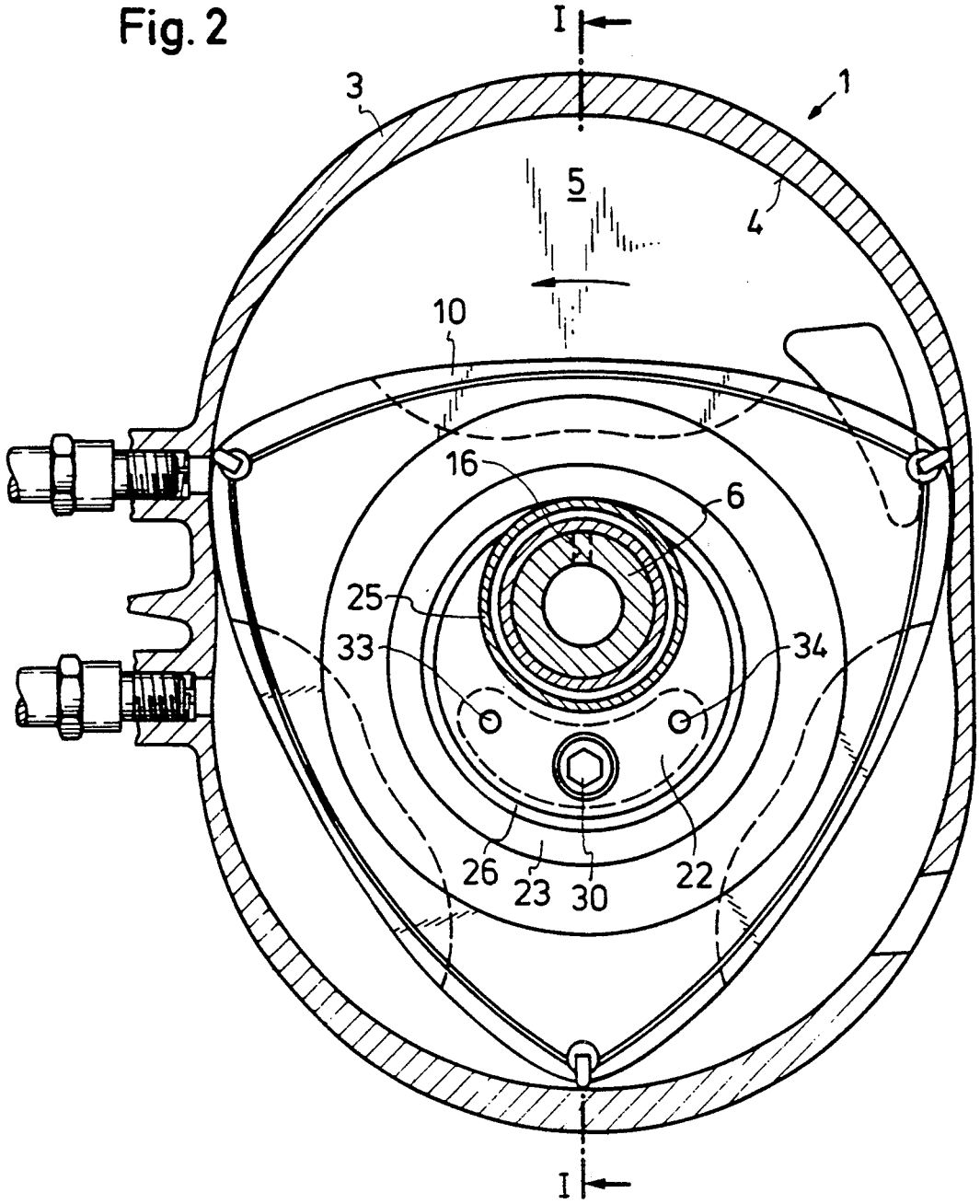
FIG. 2 is a view that shows a radial section taken along a line II—II in FIG. 1 in a plane through the same machine as in FIG. 1.

Referring now to the drawings in detail, FIG. 1 shows an axial section taken in a plane located vertically in the axis of the eccentric shaft. The housing 1 of this machine consists of a left side part 2, a casing mantle part 3 with a dual-arc trochoidal-shaped casing mantle raceway inner surface 4 and a right side part 5. The eccentric shaft 6 is journalled by bearing means 7 and 8 in the side parts 2 and 5 respectively. A triangular piston 10 rotates in a planetary movement upon an eccentric 9 journalled by an eooentric bearing 11 constructed as a slide or sleeve bearing. A synchronous transmission gear drive unit 14 is provided including a hollow gear 12 fixed or stationary on the left side of the piston 10 and this hollow gear 12 is located around the eccentric shaft 6 and the synchronous transmission gear drive unit 14 also includes a pinion fixed or rigidly connected with the sidewall 2 of the housing.

Circulation of the pressurized oil lubricating the eccentric bearing 11 and the synchronous transmission gear drive unit 14 and cooling the piston 10 begins in an axial bore 15 in the eccentric shaft 6 and has a transition via radial bore 16 in the eccentric 9 to the eccentric bearing 11. The oil or lubricant discharges from the eccentric bearing 11 laterally on one hand into the space or chamber of the synchronous transmission gear drive unit 14 and on the other hand to the right into an annular space or chamber 17 located between the piston 10 and the eccentric 9; the annular space or chamber 17 is closed-off or sealed by a sealing ring 18 sliding on the eccentric 9 and made of elastomeric oil-resistant sliding material and located in a recess in the piston. The oil or lubricant comes from this annular space or chamber 17 via bore 19 in piston 10 into cooling hollow chambers 20 thereof and from there via bores 21 into the space or chamber into the synchronous transmission gear drive unit 14.

An installation part or component 22 is threaded means inside or within the synchronous transmission gear drive unit 14 on a left sidewall of the piston 10; this installation part or component 22 has a sealing ring 23 coaxial with respect to the eccentric shaft 6 and a sealing ring 24 eccentric with respect to the eccentric shaft 6 to seal or close off the space or chamber of the transmission gear drive unit 14 with respect to the remaining housing spaces or chambers and more particularly prevents that oil flowing from the eccentric bearing 11 and from the bores 21 from the piston 10 can flow or pass into other spaces or chambers of the machine, particularly preventing that oil can penetrate into the gap space between the piston 10 and the left side part 2.

Figure 3:
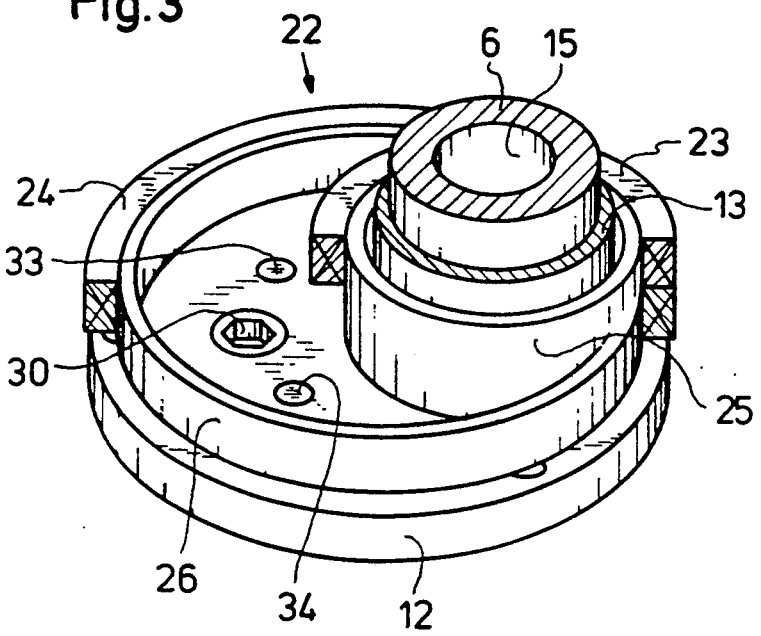
FIG. 3 is a perspective view of an installation part as seen from a left side thereof in FIG. 1.
Figure 4:
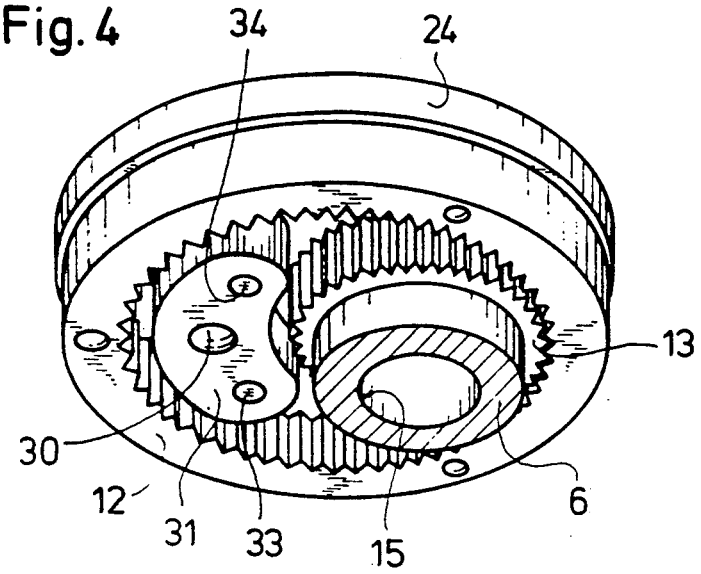
FIG. 4 is a perspective view of the same installation part as seen from a right side thereof in FIG. 1.

This insert part is illustrated in perspective in FIGS. 3 and 4. The part is formed by a hollow cylinder 25 coaxially arranged reltiave to the eccentric shaft 6 ent is open toward both sides and by a further hollow cylinder that is eccentric relative to the eccentric shaft 6 and is closed-off toward the synchronous transmission gear drive unit 14 and to the open hollow cylinder 26 is open to the open hollow cylinder 26 toward the left side part 2. The cylindrical outer surfaces of this hollow cylinder means 25 and 26 have a transition tangentially into eacn other in the eccentricity minimum of the eccentric 9, whereby the coaxial hollow cylinder 25 has double axial length, in other words, twice that of the eccentric hollow cylinder means 26 engaging before the hollow gear 12 of the synchronous transmission gear drive unit 14 with the left edge of the hollow cylinder 26 being located in a plane of the left sidewall of the piston 10. A sealing ring 24 quadratic in cross section lies or is located around the outer surface of the eccentric hollow cylinder 26; this sealing ring 24 engages securely with an outer side thereof against the shoulder 27 and the piston 10 and approaches or runs against the hollow cylinder 25, whereby the sealing ring 24 likewise does not project over the left sidewall of the piston 10. A sealing ring 23 likewise quadratic in cross section slides or glides against the outer wall of the coaxial hollow cylinder 25 and this sealing ring 2S engages securely axially in a shoulder 28 of the shaft bore 29 of the left side part 2. The space of the transmission gear drive unit 14 having oil flowing therethrough accordingly is sealed off both radially as well as axially with respect to the remaining housing chambers or spaces.

The insert part 22 is fastened with a screw 30 on the eccentric 9 and this screw is countersunk in an extension 31 that is in essence sickle-shaped or crescent-shaped, that engages between the hollow gear 12 and pinion 13 against the left sidewall 32 of the eccentric 9 and is pressed into engagement therewith by the screw 30. The crescent-shaped extension 31 is secured further by the fitting or mating pins 33 and 34 to preclude any rotation, reference being made to FIGS. 3 and 4 of the drawings.

A recess 35 in the sidewall 32 of the eccentric 9 is provided for the oil discharge or drainage from the transmission chamber into the hollow cylinder 26 in the intermediate space between the pinion 13 and the crescent-shaped extension 31. A slanted or inclined drainage bore 36 is provided in the left side part 2 for the return of oil opening into a non-illustrated oil pump behind the concentric sealing ring 23; this drainage bore 36 is connected or in communication with the space turned out between the holding part 37 of the pinion 13 fastened in the le±t side part 2 and the hollow cylinder 26 for expansion or widening of the oil path.

The path of the flow of the lubricating and cooling oil under pressure extends via the axial bore 15 and the radial bore 16 in the eccentric 9 to the eccentric bearing 11, from the sides of which such lubricating and cooling oil on the one hand reaches into the tooth means of the synchronous transmission gear drive unit 14 and on the other hand via the annular space or chamber 17 into the bores 19 respectively coming into the cooling hollow chambers 20 of the piston 10. The oil flows in both paths into the space or chamber of the synchronous transmission gear drive unit 14 and from there through the annular space or chamber between the holding part 37 for the pinion 13 and the hollow cylinder 25 into the discharge or drainage bore 36, from where the oil circulation is closed via an oil pump to the axial bore 15 in the eccentric shaft 6.

In conclusion, the rotary piston internal combustion engine consists of an oil-cooled piston journalled by slide bearings and a housing which has two side parts and a faoing mantle part with dual-arc trochoidal-shaped casing mantle runway inner surfacing; an eccentric shaft journalled in the side parts passes axially through the housing and a triangular piston journalled on an eccentric of the eccentric shaft rotates controlled or regulated by a synchronous transmission gear drive unit, which is provided in the pistons between the eccentric and one of the side parts; and the synchronous transmission gear drive unit is formed by a hollow gear fixed or stationary on the piston and a pinion fixed or stationary on the housing and located around the eccentric shaft. An insert part 22 is arranged on the eccentric 9 between the hollow gear 12 and pinion 13 of the synchronous transmission gear drive unit 14 as siding or covering therewith. The insert part 22 is sealed-off with a sealing ring 23 coaxially arranged as to the eccentric shaft 6 located on a shoulder 28 of the shaft bore 29 as arranged coaxially to the eccentric shaft in an adjoining side part 2 in engagement therewith as well as being sealed-off by a sealing ring 24 eccentric to the eccentric shaft 6 slidably sealed with respect to the remaining chambers of the housing on a shoulder 27 of the seat of the hollow gear 12 in the piston 10 arranged eccentrically to the eccentric shaft 6. Furthermore, the eccentric bearing 11 is sealed-off by a sealing ring located between the eccentric 9 and the piston 10 on a side remote from the synchronous transmission gear drive unit 14.

The rotary piston internal oombustion engine in accordance with the foregoing is further characterized by the following additional features:

(a) The insert part 22 is fastened on a sidewall 32 of the eccentric 9 with a crescent-shaped extension 31 arranged between the hollow gear 12 and pinion 13; the insert part has a hollow cylinder 26 opened to both sides and this hollow cylinder 26 lies with spacing concentrically around the holding part 37 of the pinion 13; the insert part 22 also includes a hollow cylinder 25 located eccentrically to the eccentric shaft 6 and is open toward the side part 2 and is closed toward the synchronous transmission gear drive unit 14 covering or coinciding therewith; this hollow cylinder 25 has a tangential transition into the concentric hollow cylinder 26 on the side of the eccentricity minimum of the eccentric 9.

(b) The seal ring 23 is arranged slidably on the hollow cylinder 26 ooncentric to the holding part 37 and this seal ring 23 engages securely or rigidly axially in a shoulder 28 of the shaft bore 29 in the side part 2; a sealing ring 24 is arranged slidably on the hollow cylinder 25 eccentric to the eccentric shaft 6 and this sealing ring 24 engages securely radially in a shoulder 27 of the piston 10; both sealing rings 23, 24 seal-off the space of the synchronous transmission gear drive unit 14 relative to the remaining spaces or chambers of the housing 1 as to the pressurized oil flowing through the eccentric bearing 11, piston 10 and synchronous transmission gear drive unit 14.

(c) Between the holding part 37 for the pinion 13 and the hollow cylinder 26 concentric thereto there is provided an annular space or chamber for the discharge or drainage of oil from the space or chamber of the synchronous transmission gear drive unit 14 to a drainage bore 36 in an adjoining side part 2 thereagainst.

(d) On the side remote or away from the synchronous transmission gear drive unit 14 there is arranged an annular space or chamber 17 next to the eccentric bearing 11 in the piston 10 for the oil or lubricant discharging laterally from the eccentric bearing 11 and this annular space 17 is closed-off slidably along the eccentric bearing 9, which sealing ring 18 engages rigidly or securely on the piston 10.

(e) Bores 19 lead from the annular space or chamber 17 in the piston 10 into the cooling hollow chambers or spaces 20 in the piston 10, from where further bores 21 are provided in the space or chamber of the synchronous transmission gear drive unit 14 for discharge or drainage of the cooling oil.

Finally the holding part 37 of the pinion 13 of the synchronous transmission gear drive unit 14 has a turned-out portion or recess within the hollow cylinder 25 of the insert parts 22 coaxial with the holding part 37.

The present invention is, of course. in no way restricted to the specific disclosure of the specification and drawings, but also encompasses any modifications within the scope of the appended claims.

What I claim is:

1. A rotary piston internal combustion engine having an oil cooled piston slidably jounralled for rotation and having a housing which consists of two side parts and a casing mantle part with a dual-arc trochoidal-shaped casing mantle raceway inner surfacing and having an eccentric shaft jounralled in the side parts and passing through said housing, having a triangular piston upon an eccentric of said eccentric shaft and rotating as controlled by a synchronous transmission gear drive unit, which is provided in said piston between said eccentric and a first one ofs aid side parts, said drive unit being formed by a hollow gear stationary on said piston and a pinion stationary on said housing located around said eccentric shaft, the improvement comprising:

an insert part being fastened on a sidewall of said eccentric between said hollow gear and pinion of said synchronous transmission gear drive unit covering and coinciding therewith, said insert part having a concentric hollow cylinder which is located with spacing concentrically around a holding part of said pinion and is open to both sides thereof, and a further eccentric hollow cylinder which is eccentric to said eccentric shaft and is open to said first side part and closed toward said synchronous transmission gear drive unit, said concentric hollow cylinder having a transition tangentially into said eccentric hollow cylinder along a side of an eccentricity minimum of said eccentric;

a first one-piece sealing means coaxially arranged as to said eccentric shaft adjacent to said first side part and located on a first shoulder of a shaft bore of said first side part, said first sealing means being arranged slidably on said concentric hollow cylinder and being engaged in a press-fitting manner in said first shoulder;

a second one-piece sealing means eccentric to said eccentric shaft arranged in said piston on a second shoulder provided at a seat of said hollow gear in said piston, with said second sealing means being arranged slidably on sid eccentric hollow cylinder and being engaged in a press-fitting manner in said second shoulder;

a third one-piece sealing means arranged between said eccentric and piston in a third shoulder provided at said piston for sealing off an eccentric bearing on a side remote fro msaid synchronous transmission gear drive unit, with said sealing means being slidable on said eccentric and being engaged in a press-fitting manner in said third shoulder; and said first, second and third one-piece sealing means are in the form of sealing rings and comprise an elastomeric oil-resistant material.

2. A rotary piston internal combustion engine according to claim 1, having the following additional features:

a first annular chamber means provided between said holdign part for said pinion and the said concentric hollow cylinder, said first annular chamber means being provided for discharge and drainage of oil from a space of said synchronous transmission gear drive unit to a drainage bore in said first side part adjoining to said gear drive unit;

a second annular chamber for oil discharging laterally from said eccentric bearing provided in said piston on a side remote from said synchronous transmission gear drive unit and adjoining said eccentric bearing, which second annular chamber is closed off by said third sealing means; and further bore means leading from said second annular chamber in said piston into cooling hollow chambers of said piston, from where further bores are provided for draining oil into said space of said synchronous transmission gear drive unit.

3. A rotary piston internal combustion engine according to claim 2, in which said holding part of said pinion has a turned-out recess that is coaxial with said concentric hollow cylinder and forms said first annular chamber.

* * * * *